United States Patent [19]

Woodlief

[11] 4,173,004

[45] Oct. 30, 1979

[54] MAGNETIC LATCH DEVICE FOR A CLAPPER TYPE CONTACTOR

[75] Inventor: Frederick E. Woodlief, Lexington, S.C.

[73] Assignee: Square D Company, Park Ridge, Ill.

[21] Appl. No.: 927,715

[22] Filed: Jul. 25, 1978

[51] Int. Cl.[2] ..... H01F 7/08

[52] U.S. Cl. ..... 335/236; 335/239

[58] Field of Search ..... 335/128, 170, 195, 236, 335/239, 253, 276, 165

[56] References Cited

U.S. PATENT DOCUMENTS 3,689,855 9/1972 Setone et al. ..... 335/236 X 3,777,294 12/1973 Grenier ..... 335/236

FOREIGN PATENT DOCUMENTS 1116301 11/1961 Fed. Rep. of Germany ..... 335/236

*Primary Examiner*—George Harris

*Attorney, Agent, or Firm*—M. J. Femal; R. T. Guttman

[57] ABSTRACT

A magnetic latch for a clapper type contactor having an electromechanical system comprising an operating coil, a coil core, a magnet frame, and an armature includes a magnetic latch plate. The magnetic latch plate includes a stop portion having a pair of ears mounted on a pivoted contact arm. The stop portion of the latch abuts against the magnet frame before energization of the coil so that a flux path includes the core, the magnet frame, the magnetic latch, the armature and the air gap between the armature and core of the coil. After the coil is energized and the current begins to build the magnetic latch saturates an additional parallel flux path travels from the core to the magnet frame through the heel air gap of the armature through the armature to the air gap between the armature and core of the coil until the combined force across the heel air gap and the air gap between the magnet frame and armature and the armature and the core, respectively, are greater than the force between the magnet frame and the magnetic latch, then the armature closes against the core. The amount of latch force desired is controlled by adjusting the cross-sectional area of the magnetic latch.

3 Claims, 3 Drawing Figures

FIG. 1
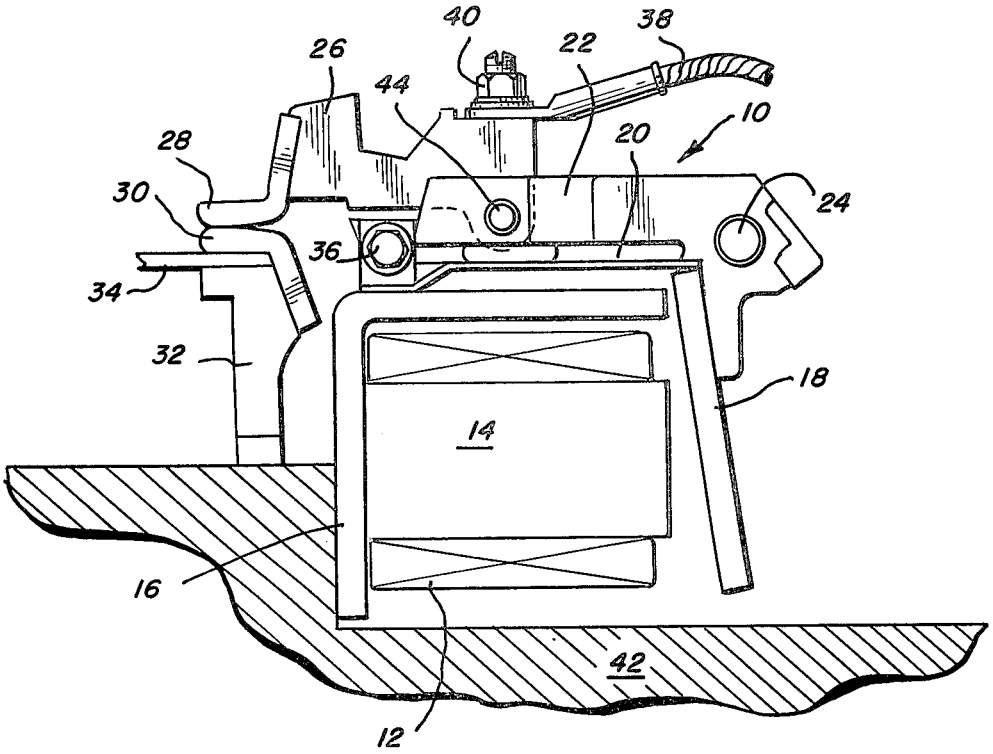
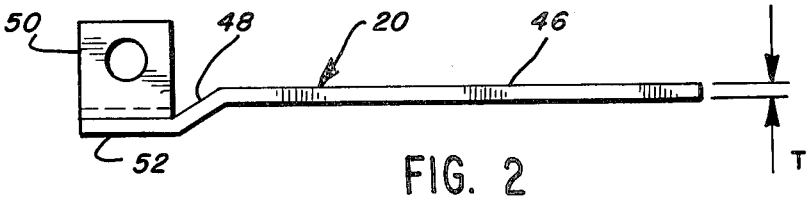
FIG. 2
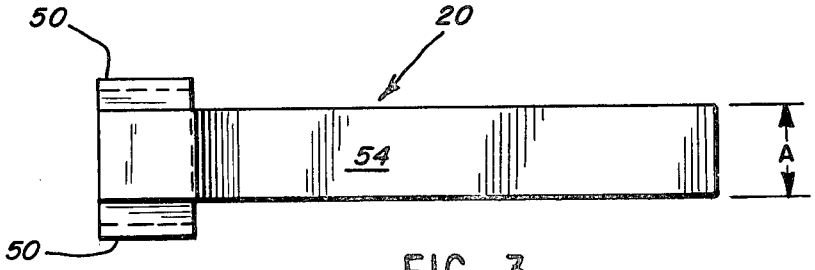
FIG. 3

MAGNETIC LATCH DEVICE FOR A CLAPPER TYPE CONTACTOR

BACKGROUND OF THE INVENTION

This invention relates to a clapper type contactor and, more particularly, to a magnetic latch which retards the movement of the armature until the magnetic force builds to a level that will carry the armature through its complete motion without hesitation.

Clapper type contactors are usually activated by coils. These type of electromechanical systems usually consist of an operating coil, a coil core, a magnet frame and an armature. To promote clean current breaks for the contact tips and to prevent welding therebetween, a continuous motion is required from seal to open of the power contact tips. Often times in the past, clapper type contactors would have their armatures move prematurely before the magnetic force builds to a level that will carry the armature through its complete motion without hesitation. Contactors including an auxiliary arm spring as well as a closing spring are especially prone to this condition with worn contact tips.

Representative prior art of a clapper type contactor in which the present invention would be most useful is shown in Schramm et al, U.S. Pat. No. 3,525,059. However, Schramm et al does not show a method to retard the armature until the magnet force builds to a level that will carry the armature through its complete motion without hesitation.

SUMMARY OF THE INVENTION

The foregoing problem of clapper type contactors in the prior art are substantially solved by the present invention. A magnetic latch circuit accomplishs the solution of the foregoing problem in which the armature movement is retarded until the magnetic force builds to a level that will carry the armature through its complete motion without hesitation. The magnetic latch circuit includes the core of an electromagnetic coil, a magnet frame upon which the core and coil are mounted, a magnetic latch having a stop surface resting upon the magnetic frame and a pair of ears extending up from the stop for securing the magnetic latch to a pivoted contact arm and an armature fixedly attached to the contact arm and pivoted therewith adjacent one end of the latch plate and extending down from the contact arm, and an air gap between the armature and the core of the coil. These elements complete a flux path for the magnetic circuit. Shortly after the current begins to build in the coil upon energization of the same, the magnetic latch plate goes into saturation and then an additional parallel flux path is established between the core, the magnetic frame, through the heel air gap of the armature, through the armature, and finally through the armature core air gap to complete the circuit. When the combined force across the heel and armature air gaps are greater than the force between the magnetic latch and the magnet frame, then the armature snaps in a detent like action to its closed position against the core of the coil. The instant the stop of the magnetic latch lifts off the surface of the magnet frame the flux changes from the magnetic latch to the magnet frame and the heel of the armature and armature back to the core.

An object of the present invention is to provide a magnetic latch circuit which retards the movement of the armature until the magnetic force in the coil builds to a level that will carry the armature through its complete motion without hesitation.

BRIEF DESCRIPTION OF THE DRAWINGS

Other objects and advantages will become apparent from the following description wherein the reference is made to the accompanied drawings illustrating the preferred embodiment of the present invention and in which:

FIG. 1 is a partial diagrammatic side view of a clapper type contactor including a magnetic latch circuit in accordance with this invention;

FIG. 2 is a side elevation of the magnetic latch shown in FIG. 1; and

FIG. 3 is a bottom view of the magnetic latch shown in FIG. 2.

DETAILED DESCRIPTION OF THE INVENTION

A preferred embodiment of a magnetic latch circuit for a clapper type contactor made in accordance with the present invention is illustrated in FIGS. 1–3.

Referring to FIG. 1, a clapper type contactor 10 is activated by an electromagnetic coil 12. The electromechanical system of the clapper type contactor 10 further includes a coil core 14 secured to a magnet frame 16 which is engaged by pivoting armature 18 upon energization of the operating coil. An additional element is added to the electromechanical system for retarding the armature movement until the magnetic force builds to a level in the coil that will carry the armature through its complete motion without hesitation. The additional element is a magnetic latch 20 which is secured to a contact arm 22 so that one end abuts the magnet frame 16 and the other end is closely adjacent the armature 18. The armature 18 fixedly attached to the contact arm 22 and depending therefrom rotates about a contact arm pivot 24 which in turn transmits the motion to an auxiliary contact arm 26 pivotally connected to the contact arm and having a movable contact tip 28 afixed thereto. A stationary contact 30 is mounted on a pedestal 32 and engages an arc runner 34.

The magnetic latch 20 is secured (to be described in greater detail later) to the contact arm 22 by a bolt 36 or the like. The auxiliary contact arm 26 is connected to a conductor 38 which is clamped to the end of the auxiliary contact arm 26 opposite the movable contact tip 28 by a clamping nut 40. The magnetic frame 16, pedestal 32 and contact arm pivot 24 (connections not shown) are all connected to a base frame 42 of any suitable insulated material.

To promote clean current breaks and to prevent welding, a continuous motion is established from sealed open of the power contact tips 28 and 30, respectively, by the magnetic latch circuit. The principle of this magnetic latch circuits operation is that, a flux path flows from the core 14 to the magnet frame 16, from there to the magnetic latch plate 20 on to the armature 18 and then through the air gap between the armature 18 and the core 14. Immediately after current begins to build in the coil, the magnetic latch plate 20 goes into saturation and then an additional parallel flux path is established which flows through the core 14, the magnet frame 16, the air heel gap between the magnet frame 16 and the armature 18 and the armature air gap between the armature 18 and the core 14 in that order. When the combined force across the heel and armature air gaps are greater than the force between the magnet frame and the magnetic latch, then the armature moves in a snap detent like action into a closed position against the core 14. At the instant the armature moves, it breaks the flux path between the magnet frame 16 and the magnet latch 20 which eliminates the flux path from the magnet frame to the magnet latch. Now all the flux travels through the latter parallel path mentioned above.

Referring now to FIGS. 2 and 3, the magnetic latch of FIG. 1 will now be described in greater detail. The magnetic latch 20 is formed out of a stamped flat piece of carbon steel or the like having a thickness T. Toward one end of the flat piece of carbon steel there is a bend 48 of more than 30° connected to a stop portion 52 in a plane parallel to the plane containing the greatest area of the plane. On either side of the stop portion 52 are a pair of opposed ears 50 extending upwardly and perpendicular to the plane of the stop portion 52 for mounting the magnetic latch 20 to the contact arm 22. As seen in FIG. 3 a magnetic latch 20 is a generally rectangular surface 54 of a width A. Depending upon the thickness T and the width A of the surface 54, the latch a cross-sectional area of the magnetic latch 20 can be varied to obtain the optimum size for the particular latching effect desired. If A or T are two great then the magnetic latch circuit will not be broken and the armature will not move to a closed position. Besides being able to determine the amount of latch force by adjusting the cross-sectional area of the latch, the magnetic latch circuit has another advantageous feature and, that is, the more the coil is operated the more efficient the latch circuit of the present invention becomes.

I claim:

1. A magnetic latch circuit for a clapper type contactor having a frame and activated by an electromagnetic coil in which the electromagnetic system of the contactor includes an operating coil having a coil core, a magnet frame connected to said operating coil and supporting the coil, and an armature, the improvement comprising:

a contact arm pivotally mounted on said frame; .

a pair of contact tips, one stationarily mounted to the frame and the other movably associated with said contact arm, said contact arm having said armature fixedly connected thereto and depending therefrom so that when the armature moves to its closed position against the coil core the contact arm pivots likewise to break open the contact tips; and means, secured to said contact arm and pivoted therewith and abutting against the magnet frame at one end thereof and closely adjacent the heel of the armature at the other end thereof, for establishing a magnetic latch by a flux path from said magnet frame to said armature so that the establishing means latches the contact arm to a fixed position which retards the movement of the armature until the magnetic force in the coil builds to a level that will carry the armature through its complete motion without hesitation.

2. The magnetic latch circuit of claim 1 wherein the establishing means is stamped out of a single piece of carbon steel.

3. A magnetic latch circuit for a clapper type contactor having a frame and activated by an electromagnetic coil in which the electromagnetic system of the contactor includes an operating coil having a coil core, a magnet frame connected to the operating coil and supporting the coil, an armature, said contactor further including a contact arm pivotally mounted on the frame, a pair of contact tips, one associated with the contact arm and the other stationarily mounted on the frame, said armature fixedly mounted on said contact arm and depending therefrom so that the contact arm and armature move in unison, the improvement comprising:

a substantially flat plate of a predetermined width and thickness to carry the optimum amount of magnetic flux;

a depending transition section attached at one end of the plate having generally the same cross-section as the plate;

a stop section attached to the other end of the transition section for abutting against the magnet frame, said stop section in a plane lower than said plate but generally parallel thereto; and an ear extending upwardly from said stop section and connected thereto for attachment to the contact arm so that the flat plate, transition section and stop section define a magnetic latch by establishing a flux path from the magnet frame which the stop section abuts against to the armature which the other end of the plate is closely adjacent thereto in order to latch the contact arm to a fixed position which retards the movement of the armature until the magnetic force in the coil builds to a level that will carry the armature through its complete motion without hesitation to clearly break the contact tips.

* * * * *